US007462589B2

(12) United States Patent
Baker et al.

(10) Patent No.: US 7,462,589 B2
(45) Date of Patent: Dec. 9, 2008

(54) DELIVERY SYSTEM FOR UNIFORM DEPOSITION OF FABRIC CARE ACTIVES IN A NON-AQUEOUS FABRIC TREATMENT SYSTEM

(75) Inventors: Keith Homer Baker, Cincinnati, OH (US); Julie Ann O'Neil, Milan, IN (US); Victor Manuel Arredondo, West Chester, OH (US); Robb Richard Gardner, Cincinnati, OH (US); Jeffrey Scott Dupont, Cincinnati, OH (US); Mark Robert Sivik, Mason, OH (US); Jeffrey Jon Hopkins, West Chester, OH (US); William Michael Scheper, Guilford, IN (US)

(73) Assignee: The Procter & Gamble Company, Cincinnati, OH (US)

( * ) Notice: Subject to any disclaimer, the term of this patent is extended or adjusted under 35 U.S.C. 154(b) by 259 days.

(21) Appl. No.: 10/876,032

(22) Filed: Jun. 24, 2004

(65) Prior Publication Data

US 2005/0000027 A1 Jan. 6, 2005

Related U.S. Application Data

(60) Provisional application No. 60/547,369, filed on Feb. 24, 2004, provisional application No. 60/483,392, filed on Jun. 27, 2003.

(51) Int. Cl.
*C11D 9/36* (2006.01)
*C11D 1/82* (2006.01)
*C11D 3/50* (2006.01)

(52) U.S. Cl. ..... 510/285; 510/276; 510/101; 510/304; 510/347; 510/466; 510/407; 510/417; 510/432; 510/528; 510/400

(58) Field of Classification Search ..... 510/276, 510/285, 101, 304, 347, 407, 417, 432, 466, 510/528, 400
See application file for complete search history.

(56) References Cited

U.S. PATENT DOCUMENTS

| | | | | |
|---|---|---|---|---|
| 2,787,596 | A | 4/1957 | Stewart et al. | |
| 3,206,951 | A | 9/1965 | Sieber | |
| 3,370,330 | A | 2/1968 | Sieber | |
| 3,401,052 | A | 9/1968 | Berger et al. | |
| 3,658,575 | A | 4/1972 | Tabor et al. | |
| 3,771,955 | A | 11/1973 | Jones | |
| 3,784,355 | A | 1/1974 | Fielding | |
| 3,953,381 | A | 4/1976 | Remond et al. | |
| 4,097,397 | A | 6/1978 | Mizutani et al. | |
| 4,102,824 | A | 7/1978 | Mizutani et al. | |
| 4,124,517 | A | 11/1978 | Hisamoto | |
| 4,432,111 | A | 2/1984 | Hoffmann et al. | |
| 4,639,321 | A | 1/1987 | Barrat et al. | |
| 4,685,930 | A | 8/1987 | Kasprzak et al. | |
| 4,708,807 | A | 11/1987 | Kemerer et al. | |
| 4,911,853 | A | 3/1990 | Coffindaffer et al. | |
| 5,057,240 | A | 10/1991 | Madore et al. | |
| 5,133,897 | A | 7/1992 | Balzer | |
| 5,219,370 | A | 6/1993 | Farrington et al. | |
| 5,705,562 | A | 1/1998 | Hill et al. | |
| 5,707,613 | A | 1/1998 | Hill et al. | |
| 5,865,851 | A | 2/1999 | Sidoti et al. | |
| 5,865,852 | A | 2/1999 | Berndt et al. | |
| 5,876,510 | A | 3/1999 | Kuemin et al. | |
| 5,888,250 | A | 3/1999 | Hayday et al. | |
| 5,942,007 | A | 8/1999 | Berndt et al. | |
| 5,968,404 | A * | 10/1999 | Trinh et al. | 252/8.91 |
| 5,977,040 | A | 11/1999 | Inada et al. | |
| 5,985,810 | A | 11/1999 | Inada et al. | |
| 6,013,682 | A | 1/2000 | Dalle et al. | |
| 6,013,683 | A | 1/2000 | Hill et al. | |
| 6,042,617 | A | 3/2000 | Berndt et al. | |
| 6,042,618 | A | 3/2000 | Berndt et al. | |
| 6,056,789 | A | 5/2000 | Berndt et al. | |
| 6,059,845 | A | 5/2000 | Berndt et al. | |
| 6,060,546 | A | 5/2000 | Powell et al. | |
| 6,063,135 | A | 5/2000 | Berndt et al. | |
| 6,083,901 | A | 7/2000 | Perry et al. | |
| 6,114,298 | A | 9/2000 | Petri et al. | |
| 6,136,766 | A | 10/2000 | Inada et al. | |
| 6,136,778 | A | 10/2000 | Kamiya | |
| 6,156,074 | A | 12/2000 | Hayday et al. | |
| 6,177,399 | B1 | 1/2001 | Mei et al. | |
| 6,200,943 | B1 | 3/2001 | Romack et al. | |
| 6,258,130 | B1 | 7/2001 | Murphy et al. | |
| 6,273,919 | B1 | 8/2001 | Hayday et al. | |
| 6,309,425 | B1 | 10/2001 | Murphy et al. | |
| 6,310,029 | B1 * | 10/2001 | Kilgour et al. | 510/466 |
| 6,312,476 | B1 | 11/2001 | Perry et al. | |

(Continued)

FOREIGN PATENT DOCUMENTS

| | | |
|---|---|---|
| DE | 1 496 248 | 2/1970 |
| DE | 26 28 480 A1 | 1/1978 |
| DE | 2644073 A1 | 4/1978 |
| DE | 37 39 711 A1 | 6/1989 |
| DE | 199 08 170 A1 | 10/1999 |
| EP | 0 182 583 | 5/1986 |
| EP | 0 246007 | 11/1987 |
| EP | 0 375 028 | 12/1989 |
| EP | 0 398 177 | 11/1990 |

(Continued)

*Primary Examiner*—Charles I Boyer
(74) *Attorney, Agent, or Firm*—Nicole M. Tepe; Kim William Zerby; Steven W. Miller

(57) ABSTRACT

A delivery system for uniform deposition of fabric care actives to a fabric article in a non-aqueous solvent based fabric treatment process; and compositions capable of uniformly depositing the fabric care actives on the fabric article being treated to achieve maximum benefit.

11 Claims, No Drawings

U.S. PATENT DOCUMENTS

| | | | | |
|---|---|---|---|---|
| 6,313,079 | B1 | 11/2001 | Murphy | |
| 6,368,359 | B1 | 4/2002 | Perry et al. | |
| 6,451,717 | B1 * | 9/2002 | Fitzgerald et al. | 442/82 |
| 6,521,580 | B2 * | 2/2003 | Perry et al. | 510/285 |
| 6,548,465 | B2 * | 4/2003 | Perry et al. | 510/285 |
| 6,610,108 | B2 | 8/2003 | Perry et al. | |
| 6,660,703 | B2 * | 12/2003 | Scheper | 510/285 |
| 6,670,317 | B2 * | 12/2003 | Severns et al. | 510/285 |
| 6,673,764 | B2 * | 1/2004 | Severns et al. | 510/419 |
| 6,706,076 | B2 * | 3/2004 | Deak et al. | 8/137 |
| 6,706,677 | B2 * | 3/2004 | Burns et al. | 510/286 |
| 6,734,153 | B2 * | 5/2004 | Scheper | 510/285 |
| 6,746,617 | B2 * | 6/2004 | Radomyselski et al. | 252/8.91 |
| 6,855,173 | B2 * | 2/2005 | Ehrnsperger et al. | 8/142 |
| 6,930,079 | B2 * | 8/2005 | Deak et al. | 510/285 |
| 2002/0004953 | A1 | 1/2002 | Perry et al. | |
| 2002/0007519 | A1 | 1/2002 | Noyes et al. | |
| 2002/0013234 | A1 * | 1/2002 | Severns et al. | 510/101 |
| 2002/0133885 | A1 | 9/2002 | Noyes et al. | |
| 2003/0060396 | A1 * | 3/2003 | Deak et al. | 510/511 |
| 2003/0074742 | A1 | 4/2003 | Perry et al. | |
| 2003/0081793 | A1 | 5/2003 | Deak et al. | |
| 2003/0115680 | A1 * | 6/2003 | Scheper | 8/142 |
| 2003/0119699 | A1 * | 6/2003 | Miracle et al. | 510/302 |
| 2003/0119711 | A1 * | 6/2003 | Scheper et al. | 510/511 |
| 2004/0142838 | A1 | 7/2004 | Azuma et al. | |
| 2004/0226106 | A1 * | 11/2004 | Gardner et al. | 8/142 |
| 2004/0231371 | A1 * | 11/2004 | Scheper et al. | 68/3 R |
| 2004/0266643 | A1 | 12/2004 | Gardner et al. | |
| 2005/0000027 | A1 | 1/2005 | Baker et al. | |
| 2005/0000028 | A1 | 1/2005 | Baker et al. | |
| 2005/0000030 | A1 | 1/2005 | Dupont et al. | |
| 2005/0003981 | A1 | 1/2005 | Sivik et al. | |
| 2005/0009723 | A1 | 1/2005 | Haeggberg et al. | |
| 2005/0137108 | A1 * | 6/2005 | Scheper et al. | 510/285 |

FOREIGN PATENT DOCUMENTS

| | | | |
|---|---|---|---|
| EP | 1 041 189 | A1 | 10/2000 |
| EP | 1 092 803 | A1 | 4/2001 |
| EP | 1 304 158 | A1 | 4/2003 |
| GB | 1059985 | | 2/1967 |
| GB | 1 252 744 | | 11/1971 |
| JP | 53018646 | A | 2/1978 |
| JP | 0 4245970 | | 9/1991 |
| JP | 5171566 | | 7/1993 |
| JP | 11323381 | | 11/1999 |
| JP | 2000-290689 | | 10/2000 |
| JP | 2003041290 | | 2/2003 |
| WO | WO 94/23012 | | 10/1997 |
| WO | WO 99/16955 | | 4/1999 |
| WO | WO 00/04221 | | 1/2000 |
| WO | WO 00/04222 | | 1/2000 |
| WO | WO 00/63340 | | 10/2000 |
| WO | WO 01/04254 | A1 | 1/2001 |
| WO | WO 01/04254 | A1 | 1/2001 |
| WO | WO 01/40567 | A1 | 6/2001 |

* cited by examiner

DELIVERY SYSTEM FOR UNIFORM DEPOSITION OF FABRIC CARE ACTIVES IN A NON-AQUEOUS FABRIC TREATMENT SYSTEM

CROSS-REFERENCE TO RELATED APPLICATIONS

This application claims the benefit of U.S. Provisional Application Ser. No. 60/547,369, filed on Feb. 24, 2004; and U.S. Provisional Application Ser. No. 60/483,392, filed on Jun. 27, 2003.

FIELD OF INVENTION

The present invention relates to a delivery system for uniform deposition of fabric care actives to a fabric article in a non-aqueous solvent based fabric treatment process. The present invention also relates to compositions capable of uniformly depositing the fabric care actives on the fabric article being treated to achieve maximum benefit.

BACKGROUND OF THE INVENTION

Cleaning applications typically involve the removal of foreign matter off surfaces. In laundry applications, this involves the removal of both hydrophobic and hydrophilic soils (food stains, blood, grass, dirt, grease, oils, etc.) off various fabrics including cotton, polyester, silk, rayon, wool and various blends of these materials. For the cleaning of fabric articles, the consumer has two choices for removal of soils: conventional water based cleaning and dry cleaning (i.e., non-aqueous based cleaning).

Conventional laundry cleaning is carried out with relatively large amounts of water, typically in a washing machine at the consumer's home, or in a dedicated place such as a coin laundry. Although washing machines and laundry detergents have become quite sophisticated, the conventional laundry process still exposes the fabric articles to a risk of dye transfer, shrinkage and wrinkling. Significant portions of fabric articles used by consumers are not suitable for cleaning in a conventional laundry process. Even fabric articles that are considered "washing machine safe" frequently come out of the laundry process badly wrinkled and require ironing.

The dry cleaning process refers to a process where low or no water is used in the cleaning system; it uses various non-aqueous organic solvents, such as halocarbons, hydrocarbons, densified carbon dioxide, glycol ethers and silicones. By avoiding the use of large amount of water, the dry cleaning process minimizes the risk of damages to the fabric articles. Generally, water-sensitive fabrics such as silk, wool, rayon, and the like, are cleaned in this manner.

However, some soils that were easily removed from fabrics in a conventional aqueous based cleaning process are not as effectively removed by conventional dry cleaning solvents. Typically, the dry-cleaner removes such soils by hand prior to the dry-cleaning process. These methods are complex, requiring a wide range of compositions to address the variety of stains encountered, very labor intensive and often result in some localized damage to the treated article.

Additionally, conventional detergent compositions are developed for water based cleaning; as such, the components (such as soil release polymers, bleaches, enzymes, other fabric care actives) therein are designed for water based cleaning processes. It has been found that these conventional cleaning agents and fabric care actives do not function efficiently in dry cleaning solvents, possibly due to low compatibility with these solvents. For example, removal of typical water-based and alcohol-based soils is very limited using the dry cleaning processes. A common problem is spotty deposition of the cleaning agents and/or fabric care actives that delivers spotty, thus unsatisfactory results. Another common problem is that the dry cleaning solvents delivers poorer wetting of the fabrics, compared to water; consequently, the cleaning agents and/or fabric care actives exhibit relatively poorer penetration into the fabrics when used in the dry cleaning process and deliver less than satisfactory results.

To maximize fabric cleaning or fabric care benefits in such a system, it is desirable to get the cleaning agents and/or fabric care actives evenly deposited on the fabric article being treated. It is also desirable to be able to efficient deposit and deliver the cleaning agents and fabric care actives to the fabric articles being treated; thus, satisfactory cleaning and/or fabric care benefits can be achieved economically by using minimal amounts of solvents and detergent components are used.

It is also desirable to have a delivery system wherein the cleaning agents and/or fabric care actives are substantially evenly dispersed such that these components are even deposited on the fabric article in a dry cleaning process.

It is further desirable that the composition contains a substantially evenly dispersed water droplets in the dry cleaning solvent matrix and the cleaning agents and/or fabric care actives are preferentially disposed in the water droplets.

SUMMARY OF THE INVENTION

The present invention relates to a method for uniform and efficient deposition of fabric care actives to a fabric article in a non-aqueous solvent based fabric treatment by using a multi-phasic delivery system. The method comprising the steps of:

(a) obtaining a delivery system comprising:
  - a first phase comprising a lipophilic fluid;
  - a second phase comprising a carrier and a fabric care active, the carrier being substantially insoluble in the lipophilic fluid; and
  - an effective amount of an emulsifying agent sufficient to emulsify the composition such that the second phase forms discrete particles;

(b) contacting a fabric article with the delivery system; and (c) removing at least a portion of the lipophilic fluid.

The present invention also relates to a method for uniform and efficient deposition of fabric care active onto a fabric article in a non-aqueous fabric treatment process comprising the steps of:

(a) obtaining a delivery system comprising a lipophilic fluid, a carrier, a fabric care active, and an emulsifying agent;

(b) contacting a fabric article with the delivery system; and (c) removing at least a portion of the lipophilic fluid;

wherein the fabric care active has a logP value of less than about 0, and the carrier is dispersed in the lipophilic fluid in the form of droplets having a median particle diameter ($\chi_{50}$) of from about 0.1 micron to about 1000 microns.

The present invention also relates to a method for uniform and efficient deposition of fabric care active onto a fabric article in a non-aqueous fabric treatment process comprising the steps of:

(a) obtaining a delivery system comprising a suspension comprising an aqueous carrier, an aqueous-insoluble fabric care active, and a carrier phase surfactant; a lipophilic fluid; and
  an emulsifying agent;

(b) contacting a fabric article with the delivery system; and (c) removing at least a portion of the lipophilic fluid;

wherein the fabric care active has a logP value of from about 1 to about −1, and the carrier is dispersed in the lipophilic fluid in the form of droplets having a median particle diameter ($\chi_{50}$) of from about 0.1 micron to about 1000 microns.

Delivery systems useful in the above methods are also provided.

DETAILED DESCRIPTION OF THE INVENTION

The term "fabric article" used herein is intended to mean any article that is customarily cleaned in a conventional laundry process or in a dry cleaning process. As such the term encompasses articles of clothing, linen, drapery, and clothing accessories. The term also encompasses other items made in whole or in part of fabric, such as carpets, tote bags, furniture covers, tarpaulins, car interior, and the like.

The terms "fabric treatment composition" or "fabric treating composition" as used herein mean a dry cleaning solvent-containing composition that comes into direct contact with fabric articles to be cleaned. It is understood that the composition may also provide uses other than cleaning, such as conditioning, sizing, and other fabric care treatments. Thus, it may be used interchangeably with the term "fabric care composition". Furthermore, optional cleaning adjuncts (such as additional detersive surfactants, bleaches, perfumes, and the like) and other fabric care agents may be added to the composition.

The term "dry cleaning" or "non-aqueous cleaning" as used herein means a non-aqueous fluid is used as the dry cleaning solvent to clean a fabric article. However, water can be added to the "dry cleaning" method as an adjunct cleaning agent. The amount of water can comprise up to about 25% by weight of the dry cleaning solvent or the cleaning composition in a "dry cleaning" process. The non-aqueous fluid is referred to as the "lipophilic fluid" or "dry cleaning solvent".

The terms "fabric care actives" or "actives" as used herein refer to the components that deliver the desired fabric care benefits to the fabric article being treated. The fabric care actives include detersive or cleaning agents that provide fabric cleaning benefits as well as fabric enhancers that provide fabric softening, odor, fabric repairs and/or improvements, and the like. On the other hand, the terms "adjunct ingredients" or "adjuncts" refer to the adjunct components incorporated into the delivery system to provide additional fabric care benefits; however, the adjuncts may be located any where in the composition, including the first phase, the second phase, or the interphase. The actives and adjuncts can be a liquid or a solid.

The term "soil" means any undesirable substance on a fabric article that is desired to be removed. By the terms "water-based" or "hydrophilic" soils, it is meant that the soil comprised water at the time it first came in contact with the fabric article, that the soil has high water solubility or affinity, or the soil retains a significant portion of water on the fabric article. Examples of water-based soils include, but are not limited to beverages, many food soils, water soluble dyes, bodily fluids such as sweat, urine or blood, outdoor soils such as grass stains and mud.

The term "water soluble" as used herein means at least about 90% by weight of the fabric care active dissolves in water. The term "water insoluble" as used herein means no more than about 10% by weight of the fabric care active dissolves in water. The term "partially water soluble" as used herein encompasses all other fabric care actives.

All percentages are weight percents unless specifically stated otherwise.

All molecular weights are weight-average molecular weights that are determined by Gel Permeation Chromatography (GPC).

Delivery System

The delivery system of the present invention is a fabric treatment composition comprises a first phase, a second phase and an effective amount of an emulsifier such that the second phase forms discrete droplets in the continuous first phase. The second phase comprises a carrier and at least one fabric care active. As used herein the terms "delivery system", "delivery composition" and "fabric treatment composition" are synonymous.

Typically, the second phase form discrete droplets having a median particle diameter $\chi_{50}$ of less than about 1000 μm, or less than about 500 μm, or less than about 100 μm. The median particle size is determined by the test method ISO 13320-1:1999(E), wherein $\chi_{50}$ defined as "median particle diameter, μm" on a volumetric basis, i.e., 50% by volume of the particles is smaller than this diameter and 50% is larger. In some embodiments, the median particle size of the second phase droplet ranges from about 0.1 to about 1000 μm, or from about 1 to about 500 μm, or from about 5 to about 100 μm.

Alternatively, the discrete droplets of the second phase can be characterized by the same test method ISO 13320-1:1999, wherein in a 1 mL sample of the delivery system, has greater than about 0.95 weight fraction of the first phase contained in droplets, each droplet having an individual weight of less than 1 wt %, preferably less than 0.5 wt %, and more preferably less than 0.1 wt % of the total mass of the first phase in the 1 mL sample of the delivery system.

The first phase comprises a lipophilic fluid, which is described in more details below. In one embodiment, the lipophilic fluid is selected from the group consisting of silicones, glycol ethers, glycerol ethers, fluorocarbons, hydrocarbons, and mixtures thereof. In another embodiment, the lipophilic fluid comprises decamethylcyclopentasiloxane and/or other cyclic siloxanes solvents. Typically, the first phase comprises at least about 50%, or from about 60 to about 99.99%, or from about 70 to about 95%, or from about 80 to about 90% by weight of the composition.

The carrier comprises water, and in some embodiments, lower alcohols, such as C1-C6 linear or branched alcohols, and lower glycol, such as C1-C4 glycols, can be added to water. Typically, the carrier comprises from about 0.01% to about 5%, or from about 0.05% to about 2%, or from about 0.1% to about 1% by weight of the composition. The carrier and the fabric care actives in the delivery system of the present invention have a weight ratio of from about 1000:1 to about 1:3, or from about 500:1 to about 1:1, or from about 100:1 to about 3:1.

Nonlimiting examples of emulsifiers suitable for use herein are described in details below. The emulsifiers can have a lipophilic portion and a hydrophilic portion, such as those described in U.S. Provisional Patent Applications Ser. Nos. 60/483,343 and 60/482,958, both of which were filed on Jun. 27, 2003 (P&G case 9288P and 9318P). Typically, the carrier and the emulsifying agent in the delivery system of the present invention have a weight ratio of from about 10000:1 to about 1:1, or from about 5000:1 to about 10:1, or from about 1000:1 to about 50:1. It is also known that these emulsifiers can also function as detersive surfactants in the lipophilic fluid phase. Thus, additional amount of these emulsifiers can also be included in the delivery system. In some embodiments, the total amount of the emulsifying agent in the delivery system to the amount of lipophilic fluid range from about 10000:1 to about 1:1 (w: w), or from about 5000:1 to about 10:1 (w:w), or from about 1000:1 to about 50:1 (w:w).

Fabric care actives suitable for use in the present invention can have a higher affinity for water than for the lipophilic fluid. The affinity can be defined by logP, a partition coefficient of lipophilic fluid/water. In the delivery system of the present invention, a fabric care active partitioned between water and the lipophilic fluid. In one embodiment, the fabric care active is more soluble in water than in the lipophilic fluid. In other words, the fabric care active has a logP of less than about 0. In another embodiment, the fabric care active is about equally soluble in water as in the lipophilic fluid. In other words, the fabric care active has a logP of from about −1 to about 1. A method for determining the partition coefficient of a compound in two incompatible liquids is described in "Determination of n-Octanol/Water Partition Coefficient (Kow) of Pesticides Critical Review and Comparison of Methods", A. Finizio; M. Vighi; and D. Sandroni, Chemosphere Vol. 34(1), pages 131-161 (1997). The value of logP of a fabric care active can be determined by adapting this partitioning method by mixing the fabric care active with a lipophilic fluid and water.

The delivery system of the present invention overcomes the problems encountered when the fabric care actives used in the non-aqueous treatment process are not soluble or incompatible with the non-aqueous solvent. These fabric care actives tend to separate from the lipophilic fluid, to form agglomerates suspended therein, or in extreme cases, to precipitate out of the lipophilic fluid. When the lipophilic fluid carrying the fabric care actives is applied to the fabric article, the fabric care actives often produce uneven or spotting treatment results.

It is observed that fabric care actives being delivered by a single phase lipophilic liquids tend to provide spotting depositions and tend to stay on the fabric surface. It is surprising to find that by adding a small amount of carrier (such as water) to the lipophilic fluid, the fabric care actives can be efficiently and substantially uniformly deposited on the fabric article being treated and deliver satisfactory results. The uniformity of the deposition can be demonstrated by a test based on AATCC Test Method 118-1997 described herein below.

The efficiency of the deposition can be demonstrated by the same test method, with an added step to quantify the residual amount of fabric care actives remain in the lipophilic fluid. The difference between the amount of actives added to the delivery system and the residual amount of actives is the amount deposited onto the fabric. In a typical embodiment, at least about 70%, or at least about 90%, or at least about 90% by weight of the actives are deposited onto the fabric.

Not wishing to be bound by theory, it is believed that several factors in the delivery system need to be properly controlled/balanced to provide the desired results. First, the fabric care actives are preferentially partitioned into water. Second, water phase is sufficiently emulsified to form small discrete droplets, which are substantially homogeneously dispersed in the continuous first phase. Here, the emulsifier is believed to function to reduce the particle size of the water phase as well as to maintain the phase stability such that agglomeration of the dispersed phase with time is minimized or slowed. When the delivery system of the present invention is applied to a fabric article, the water droplets are substantially uniformly deposited on the fabric article. Moreover, due to the affinity between water and fibers, the water droplets preferentially wet and/or being absorbed into the fabrics, thus, the fabric care actives in the water phase are able to penetrate into the fabrics to provide an enhanced fabric treating benefits to the fabric.

(1) Lipophilic Fluid

"Lipophilic fluid" as used herein means any liquid or mixture of liquid that is immiscible with water at up to 20% by weight of water. In general, a suitable lipophilic fluid can be fully liquid at ambient temperature and pressure, can be an easily melted solid, e.g., one that becomes liquid at temperatures in the range from about 0° C. to about 60° C., or can comprise a mixture of liquid and vapor phases at ambient temperatures and pressures, e.g., at 25° C. and 1 atm. pressure.

It is preferred that the lipophilic fluid herein be non-flammable or, have relatively high flash points and/or low VOC characteristics, these terms having conventional meanings as used in the dry cleaning industry, to equal to or exceed the characteristics of known conventional dry cleaning fluids.

Non-limiting examples of suitable lipophilic fluid materials include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

"Siloxane" as used herein means silicone fluids that are non-polar and insoluble in water or lower alcohols. Linear siloxanes (see for example U.S. Pat. Nos. 5,443,747, and 5,977,040) and cyclic siloxanes are useful herein, including the cyclic siloxanes selected from the group consisting of octamethyl-cyclotetrasiloxane (tetramer), dodecamethyl-cyclohexasiloxane (hexamer), decamethyl-cyclopentasiloxane (pentamer, commonly referred to as "D5" ), and mixtures thereof. A preferred siloxane comprises more than about 50% cyclic siloxane pentamer, or more than about 75% cyclic siloxane pentamer, or at least about 90% of the cyclic siloxane pentamer. Also preferred for use herein are siloxanes that are a mixture of cyclic siloxanes having at least about 90% (or at least about 95%) pentamer and less than about 10% (or less than about 5%) tetramer and/or hexamer.

The lipophilic fluid can include any fraction of dry-cleaning solvents, especially newer types including fluorinated solvents, or perfluorinated amines. Some perfluorinated amines such as perfluorotributylamines, while unsuitable for use as lipophilic fluid, may be present as one of many possible adjuncts present in the lipophilic fluid-containing composition.

Other suitable lipophilic fluids include, but are not limited to, diol solvent systems e.g., higher diols such as $C_6$ or $C_8$ or higher diols, organosilicone solvents including both cyclic and acyclic types, and the like, and mixtures thereof.

Non-limiting examples of low volatility non-fluorinated organic solvents include for example OLEAN® and other polyol esters, or certain relatively nonvolatile biodegradable mid-chain branched petroleum fractions.

Non-limiting examples of glycol ethers include propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether.

Non-limiting examples of other silicone solvents, in addition to the siloxanes, are well known in the literature, see, for example, Kirk Othmer's Encyclopedia of Chemical Technology, and are available from a number of commercial sources, including GE Silicones, Toshiba Silicone, Bayer, and Dow Corning. For example, one suitable silicone solvent is SF-1528 available from GE Silicones.

Non-limiting examples of suitable glycerine derivative solvents for use in the present invention have the following structure:

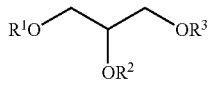

wherein $R^1$, $R^2$ and $R^3$ are each independently selected from: H; branched or linear, substituted or unsubstituted $C_1$-$C_{30}$ alkyl, $C_2$-$C_{30}$ alkenyl, $C_1$-$C_{30}$ alkoxycarbonyl, $C_3$-$C_{30}$ alkyleneoxyalkyl, $C_1$-$C_{30}$ acyloxy, $C_7$-$C_{30}$ alkylenearyl; $C_4$-$C_{30}$ cycloalkyl; $C_6$-$C_{30}$ aryl; and mixtures thereof. Two or more of $R^1$, $R^2$ and $R^3$ together can form a $C_3$-$C_8$ aromatic or non-aromatic, heterocyclic or non-heterocyclic ring.

Non-limiting examples of suitable glycerine derivative solvents include 2,3-bis(1,1-dimethylethoxy)-1-propanol; 2,3-dimethoxy-1-propanol; 3-methoxy-2-cyclopentoxy-1-propanol; 3-methoxy-1-cyclopentoxy-2-propanol; carbonic acid (2-hydroxy-1-methoxymethyl)ethyl ester methyl ester; glycerol carbonate and mixtures thereof.

Non-limiting examples of other environmentally-friendly solvents include lipophilic fluids that have an ozone formation potential of from about 0 to about 0.31, lipophilic fluids that have a vapor pressure of from about 0 to about 0.1 mm Hg, and/or lipophilic fluids that have a vapor pressure of greater than 0.1 mm Hg, but have an ozone formation potential of from about 0 to about 0.31. Non-limiting examples of such lipophilic fluids that have not previously been described above include carbonate solvents (i.e., methyl carbonates, ethyl carbonates, ethylene carbonates, propylene carbonates, glycerine carbonates) and/or succinate solvents (i.e., dimethyl succinates).

"Ozone Reactivity" as used herein is a measure of a VOC's ability to form ozone in the atmosphere. It is measured as grams of ozone formed per gram of volatile organics. A methodology to determine ozone reactivity is discussed further in W. P. L. Carter, "Development of Ozone Reactivity Scales of Volatile Organic Compounds", Journal of the Air & Waste Management Association, Vol. 44, Page 881-899, 1994. "Vapor Pressure" as used can be measured by techniques defined in Method 310 of the California Air Resources Board.

In one embodiment, the lipophilic fluid comprises more than 50% by weight of the lipophilic fluid of cyclopentasiloxanes, ("D5") and/or linear analogs having approximately similar volatility, and optionally complemented by other silicone solvents.

(2) Emulsifying Agent

Suitable emulsifying agents or emulsifiers may comprise a lipophilic portion and a hydrophilic portion, and are capable of suspending water in lipophilic fluids. For example, the emulsifier suitable for use in the present invention has the general formula:

$$Y_u\text{-}(L_t\text{-}X_v)_x\text{-}Y'_w \quad \text{(I)}$$

$$L_y\text{-}(X_v\text{-}Y_u)_x\text{-}L'_z \quad \text{(II)}$$

and mixtures thereof;

wherein L and L' are solvent compatibilizing (or lipophilic) moieties, which are independently selected from:

(a) C1-C22 alkyl or C4-C12 alkoxy, linear or branched, cyclic or acyclic, saturated or unsaturated, substituted or unsubstituted;

(b) siloxanes having the formula:

$$M_aD_bD'_cD''_d \quad \text{(III)}$$

wherein a is 0-2; b is 0-1000; c is 0-50; d is 0-50, provided that a+c+d is at least 1;

M of formula (III) is $R^1_{3-e}X_eSiO_{1/2}$ wherein $R^1$ of formula (III) is independently H, or an alkyl group, X of formula (III) is hydroxyl group, and e is 0 or 1;

D of formula (III) is $R^4_2SiO_{2/2}$ wherein $R^4$ of formula (III) is independently H or an alkyl group;

D' of formula (III) is $R^5_2SiO_{2/2}$ wherein $R^5$ of formula (III) is independently H, an alkyl group, or $(CH_2)_f(C_6Q_4)_gO$—$(C_2H_4O)_h$—$(C_3H_6O)_i(C_kH_{2k})_j$—$R^3$, provided that at least one $R^5$ of formula (III) is $(CH^2)_f(C_6Q_4)_gO$—$(C_2H_4O)_h$—$(C_3H_6O)_i(C_kH_{2k})_j$—$R^3$ (referred to as formula IIIb), wherein $R^3$ of formula (IIIb) is independently H, an alkyl group or an alkoxy group, f of formula (IIIb) is 1-10, g of formula (IIIb) is 0 or 1, h of formula (IIIb) is 1-50, i of formula (IIIb) is 0-50, j of formula (IIIb) is 0-50, k of formula (IIIb) is 4-8; $C_6Q_4$ of formula (IIIb) is unsubstituted or substituted with Q of formula (IIIb) is independently H, $C_{1-10}$ alkyl, $C_{1-10}$ alkenyl, and mixtures thereof.

D" of formula (III) is $R^6_2SiO_{2/2}$ wherein $R^6$ of formula (III) is independently H, an alkyl group or $(CH_2)_l(C_6Q_4)_m(A)_n$-$[(T)_o$-$(A')_p$-$]_q$-$(T')_rZ(G)_s$(referred to as formula IIIc), wherein l of formula (IIIc) is 1-10; m of formula (IIIc) is 0 or 1; n of formula (IIIc) is 0-5; o of formula (IIIc) is 0-3; p of formula (IIIc) is 0 or 1; q of formula (IIIc) is 0-10; r of formula (IIIc) is 0-3; s of formula (IIIc) is 0-3; $C_6Q_4$ of formula (IIIc) is unsubstituted or substituted with Q of formula (IIIc) is independently H, $C_{1-10}$ alkyl, $C_{1-10}$ alkenyl, and mixtures thereof; A and A' of formula (IIIc) are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; T and T' of formula (IIIc) are each independently a $C_{1-30}$ straight chained or branched alkyl or alkenyl or an aryl which is unsubstituted or substituted; Z of formula (IIIc) is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium; G of formula (IIIc) is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate;

Y and Y' are hydrophilic moieties, which are independently selected from hydroxy; polyhydroxy; C1-C3 alkoxy; mono- or di-alkanolamine; C1-C4 alkyl substituted alkanolamine; substituted heterocyclic containing O, S, N; sulfates; carboxylate; carbonate; and when Y and/or Y' is ethoxy (EO) or propoxy (PO), it must be capped with R, which is selected from the group consisting of:

(i) a 4 to 8 membered, substituted or unsubstituted, heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

X is a bridging linkage selected from O; S; N; P; C1 to C22 alkyl, linear or branched, saturated or unsaturated, substituted or unsubstituted, cyclic or acyclic, aliphatic or aromatic, interrupted by O, S, N, P; glycidyl, ester, amido, amino, $PO_4^{2-}$, $HPO_4^{-}$, $PO_3^{2-}$, $HPO_3^{-}$, which are protonated or unprotonated;

u and w are integers independently selected from 0 to 20, provided that u+w≧1;

t is an integer from 1 to 10;

v is an integer from 0 to 10;

x is an integer from 1 to 20; and y and z are integers independently selected from 1 to 10.

Nonlimiting examples of emulsifiers having the above formula include alkanolamines; phophate/phosphonate esters; gemini surfactants including, but are not limited to, gemini diols, gemini amide alkoxylates, gemini amino alkoxylates; capped nonionic surfactants; capped silicone surfactants such as nonionic silicone ethoxylates, silicone amine derivatives; alkyl alkoxylates; polyol surfactants; and mixtures thereof. Detailed description of these emulsifiers is found in U.S. Provisional Patent Applications Ser. Nos. 60/483,343 and 60/482,958.

Yet another class of suitable emulsifiers are organosulfosuccinates, with carbon chains of from about 6 to about 20 carbon atoms. In one embodiment, the organosulfosuccinates contain dialkly chains, each with carbon chains of from about 6 to about 20 carbon atoms. IN another embodiment, the organosulfosuccinates have chains containing aryl or alkyl aryl, substituted or unsubstituted, branched or linear, saturated or unsaturated groups. Nonlimiting commercially available examples of suitable organosulfosuccinate surfactants are available under the trade names of Aerosol OT® and Aerosol TR-70® (ex. Cytec).

(3) Fabric Care Actives

Suitable fabric care actives can be water soluble or partially water soluble materials (e.g., bleaches, enzymes), or water insoluble liquids (e.g., perfumes). Suitable fabric care actives also include water insoluble solids (e.g., fluoro or silicone soil release polymers).

Nonlimiting examples of specific fabric care actives for use in the delivery systems and methods of the present invention include soil release polymers, bleaches, enzymes, perfumes, softening agents, finishing polymers, dye transfer inhibiting agents, dye fixatives, UV protection agents, wrinkle reducing/removing agents, fabric rebuild agents, fiber repair agents, perfume release and/or delivery agents, shape retention agents, fabric and/or soil targeting agents, antibacterial agents, anti-discoloring agents, hydrophobic finishing agents UV blockers, brighteners, pigments (e.g., $Al_2O_3$, TiO2), pill prevention agents, temperature control technology, skin care lotions (comprising humectants, moisturizers, viscosity modifiers, fragrance, etc.), fire retardants, and mixtures thereof.

In a specific embodiment of the present invention, the following fabric care actives are particularly desirable in the delivery system: soil release polymers, bleaches, enzymes, perfumes, softening agents, and mixtures thereof.

(a) Soil Release Polymer

The term "soil-release" as used herein refers to the ability of the fabric article to be washed or otherwise treated to remove soils that have come into contact with the fabric article. The present invention does not wholly prevent the attachment of soil to the fabric article, but hinders such attachment and improves the cleaning of the fabric article. Nonlimiting examples of soil release polymers suitable for use herein include fluorine-containing soil release polymers and silicone-containing soil release polymers.

In one embodiment, the soil release polymers are substantially insoluble in water and are prepared as dispersions in water. When such water dispersions is applied directed to the fabric article, it does not achieve effective deposition of the soil release polymer onto the fabric article, as measured by AATCC Test Method 118-1997 which is discussed in more detail below. It has been found that effective deposition of the soil release polymer, as measured by AATCC Test Method 118-1997, may be achieved through the use of the delivery system of the present invention.

Examples of fluorine-containing soil release polymers (fluoro-SRPs) useful in the present invention can be a polymer derived from perfluoroalkyl monomers, or from a mixture of perfluoroalkyl monomers and alkyl (meth)acrylate monomers. The perfluoroalkyl monomer has the formula:

$$R_f\text{-Q-A-C(O)—C(R)=CH}_2 \quad \text{(IV)}$$

wherein $R_f$ of formula (IV) is a linear or branched perfluoroalkyl group containing from 2 to about 20 carbon atoms; R of formula (IV) is H or $CH_3$; A is O, S, or N(R'); Q of formula (IV) is alkylene of 1 to about 15 carbon atoms, hydroxyalkylene of 3 to about 15 carbon atoms, $—(C_nH_{2n})(OC_qH_{2q})_m—$, $—SO_2—NR'(C_nH_{2n})—$, or $—CONR'(C_nH_{2n})—$; wherein R' is H or alkyl of 1 to about 4 carbon atoms; n is 1 to about 15; q is 2 to about 4; and m is 1 to about 15.

In one embodiment, the fluoroalkyl monomer is a perfluoroalkylethyl (meth)acrylate. In another embodiment, the perfluoroalkyl carbon chain length distribution by weight is about 50% of 8-carbon, about 29% of 10-carbon, about 11% of 12-carbon, and the balance of 6-carbon, 14-carbon and longer chain lengths. This composition is available as ZONYL TA-N® from E.I. du Pont de Nemours and Company of Wilmington, Del. The proportion of fluoroalkyl monomer is at least about 70% relative to the total weight of copolymer.

The alkyl (meth)acrylate monomer has the formula:

$$R'—O—C(O)—C(R)=CH_2 \quad \text{(V)}$$

wherein R" of formula (V) is independently selected from H, linear or branched alkyl groups of about 1 to about 24 carbons, linear or branched alkyl groups of about 1 to about 24 carbons modified to contain 1 to 3 nitrogens, and mixtures thereof; and R of formula (V) is H or $CH_3$. The alkyl (meth) acrylate is added so as to constitute 5-25% of the monomer chain units on a weight basis. In one embodiment, the alkyl (meth)acrylate is stearyl methacrylate. More detailed disclosure of these and other fluoro-meth(acrylate) SRPs can be found in U.S. Pat. No. 6,451,717.

Exemplary fluoro-SRPs are commercially available under the tradename REPEARL F35® in an aqueous suspension form from Mitsubishi, and under the tradenames ZONYL 7060®, ZONYL 8300®, and ZONYL 8787® from DuPont. Other suitable fluoro-SRPs are disclosed in WO 01/98384, WO 01/81285; JP 10-182814; JP 2000-273067; WO 98/4160213, and WO 99/69126.

Exemplary silicone-containing soil release polymers (Si-SRPs) can have the following formula (VI):

$$M_aD_bD'_cT_d(D_eM_a)_{1+d} \quad \text{(VI)}$$

wherein a of formula (VI) is 0-2; b of formula (VI) is 0-1000; c of formula (VI) is 0-200; d of formula (VI) is 0-1; e of formula (VI) is 0-1000, provided that a+c+d+e of formula (VI) is at least 1;

M of formula (VI) is $R^1_{3-f}X_fSiO_{1/2}$ wherein $R^1$ of formula (VI) is independently H, or an alkyl group, X of formula (VI) is hydroxyl, alkoxy group, and f is 0 or 1;

D of formula (VI) is $R^4_2SiO_{2/2}$ wherein $R^4$ of formula (VI) is independently H or an alkyl group;

D' of formula (VI) is $R^5_2SiO_{2/2}$ wherein $R^5$ of formula (VI) is independently H, an alkyl group or $(CH_2)_g(C_6Q_4)_h(A)_i$-$[(L)_j$-$(A')_k$-$]_l$ (referred to as formula VIa), wherein g of formula (VIa) is 1-10; h of formula (VIa) is 0 or 1; i of formula (VIa) is 0-5; j of formula (VIa) is 0-3; k of formula (VIa) is 0 or 1; l of formula (VIa) is 0-10; $C_6Q_4$ of formula (VIa) is unsubstituted or substituted with Q of formula (VIa) is independently H, C1-C10 alkyl, C1-C10 alkenyl, and mixtures thereof; A and A' of formula (VIa) are each independently a linking moiety representing an ether, an amido, an amino, a C1-C4 fluoroalkyl, a C1-C4 fluoroalkenyl, an ammonium, and mixtures thereof; L of formula (VIa) is a C1-C30 straight chained or branched alkyl or alkenyl or an aryl which is unsubstituted or substituted;

T of formula (VI) is $R^6_1SiO_{3/2}$ wherein $R_6$ of formula (VI) is $(CH_2)_m(C_6Q_4)_n(A)_o$-$[(L)_p$-$(A')_q$-$]_r$ (referred to as formula VIb), wherein m of formula (VIb) is 1-10; n of formula (VIb) is 0 or 1; o of formula (VIb) is 0-5; p of formula (VIb) is 0-3; q of formula (VIb) is 0 or 1; r of formula (VIb) is 0-10; $C_6Q_4$ of formula (VIb) is unsubstituted or substituted with Q of formula (VIb) is independently H, C1-C10 alkyl, C1-C10 alkenyl, and mixtures thereof; A and A' of formula (VIb) are each independently a linking moiety representing an ether, an amido, an amino, a C1-C4 fluoroalkyl, a C1-C4 fluoroalkenyl, an ammonium, and mixtures thereof; L of formula (VIb) is a $C_{1-30}$ straight chained or branched alkyl or alkenyl or an aryl which is unsubstituted or substituted.

Silicone SRP suitable for use in the non-aqueous system of the present invention has a weight-average molecular weight in the range from about 1000 to about 10,000,000, or from about 5000 to about 5,000,000, or from about 10,000 to about 1,000,000. For example, when the Si-SRP is a curable aminosilicone, it tends to have a low molecular weight from about 1000 to about 100,000. The curable Si SRP is relatively flowable when applied to the fabrics and can be cured to form a soil repellent, film-like layer over the fabric surface. In other examples, Si-SRPs having molecular weight higher than 100,000 are used in the delivery system of the present invention to deposit the Si-SRPs onto fabric surface without further curing.

Exemplary Si-SRPs are commercially available as DF104, DF1040, SM2125, SM2245, SM2101, SM2059 from GE, and Dow Corning 75SF® Emulsion.

Also suitable for use as soil release polymer in the present invention are water soluble modified celluloses which include, but are not limited to: carboxymethylcellulose, hydroxypropylcellulose, methylcellulose, and like compounds. These compounds, and other suitable compounds, are described in Kirk Othmer Encyclopedia of Chemical Technology, $4^{th}$ Edition, vol. 5, pages 541-563, under the heading of "Cellulose Ethers", and in the references cited therein.

Another class of suitable soil release polymers may comprise block copolymers of polyalkylene terephthalate and polyoxyethylene terephthalate, and block copolymers of polyalkylene terephthalate and polyethylene glycol. These compounds are disclosed in details in are discussed in U.S. Pat. No. 6,358,914 and U.S. Pat. No. 4,976,879.

Another class of soil release polymer is a crystallizable polyester comprising ethylene terephthalate monomers, oxyethylene terephthalate monomers, or mixtures thereof. Examples of this polymer are commercially available as Zelcon 4780® (from DuPont) and Milease T® (from ICI). A more complete disclosure of these soil release agents is contained in EP 0 185 427 A1.

(b) Bleach

Nonlimiting examples of suitable bleaches are selected from the group consisting of catalytic metal complexes, activated peroxygen sources, bleach activators, bleach boosters, photobleaches, free radical initiators and hyohalite bleaches.

Examples of suitable catalytic metal complexes include, but are not limited to, manganese-based catalysts such as $Mn^{IV}_2$ $(u\text{-}O)_3$(1,4,7-trimethyl-1,4,7-triazacyclononane)$_2$ $(PF_6)_2$ disclosed in U.S. Pat. No. 5,576,282, cobalt based catalysts disclosed in U.S. Pat. No. 5,597,936 such as cobalt pentaamine acetate salts having the formula $[Co(NH_3)_5OAc]T_y$, wherein "OAc" represents an acetate moiety and "$T_y$" is an anion; transition metal complexes of a macropolycyclic rigid ligand—abreviated as "MRL". Suitable metals in the MRLs include Mn, Fe, Co, Ni, Cu, Cr, V, Mo, W, Pd, and Ru in their various oxidation states. Examples of suitable MRLs include: Dichloro-5,12-diethyl-1,5,8,12-tetraazabicyclo[6.6.2]hexadecane Manganese(II), Dichloro-5,12-diethyl-1,5,8,12-tetraazabicyclo[6.6.2]hexadecane Manganese(III) Hexafluorophosphate and Dichloro-5-n-butyl-12-methyl-1,5,8,12-tetraaza-bicyclo[6.6.2]hexadecane Manganese(II). Suitable transition metal MRLs are readily prepared by known procedures, such as taught for example in WO 00/332601, and U.S. Pat. No. 6,225,464.

Suitable activated peroxygen sources include, but are not limited to, preformed peracids, a hydrogen peroxide source in combination with a bleach activator, or a mixture thereof. Suitable preformed peracids include, but are not limited to, compounds selected from the group consisting of percarboxylic acids and salts, percarbonic acids and salts, perimidic acids and salts, peroxymonosulfuric acids and salts, and mixtures thereof. Suitable sources of hydrogen peroxide include, but are not limited to, compounds selected from the group consisting of perborate compounds, percarbonate compounds, perphosphate compounds and mixtures thereof. Suitable types and levels of activated peroxygen sources are found in U.S. Pat. Nos. 5,576,282, 6,306,812 B1 and 6,326,348 B1 that are incorporated by reference.

Suitable bleach activators include, but are not limited to, perhydrolyzable esters and perhydrolyzable imides such as, tetraacetyl ethylene diamine, octanoylcaprolactam, benzoyloxybenzenesulphonate, nonanoyloxybenzenesulphonate, benzoylvalerolactam, dodecanoyloxybenzenesulphonate.

Suitable bleach boosters include, but are not limited to, those described U.S. Pat. No. 5,817,614.

(c) Enzyme

Nonlimiting examples of suitable enzymes include proteases, amylases, cellulases, lipases, and others. Suitable proteases include subtilisins from *Bacillus* (e.g. *subtilis, lentus, licheniformis, amyloliquefaciens* (BPN, BPN'), *alcalophilus*) under the tradenames of Esperase®, Alcalase®, Everlase® and Savinase® (from Novozymes), BLAP and variants (from Henkel). Other suitable proteases are described in EP130756, WO 91/06637, WO 95/10591 and WO99/20726. Suitable amylases (α and/or β) are described in WO 94/02597 and WO 96/23873. Nonlimiting examples of commercially available amylases include Purafect Ox Am® (from Genencor) and Termamyl®, Natalase®, Ban®, Fungamyl® and Duramyl® (from Novozymes). Suitable cellulases include bacterial or fungal cellulases, such as those produced by *Humicola insolens*, particularly DSM 1800 (commercially avaialbe as Carezyme®). Other suitable cellulases are the EGIII cellulases produced by *Trichoderma longibrachiatum*. Suitable lipases include those produced by *Pseudomonas* and *Chromobacter* groups. Nonlimiting examples of commercially available lipases include Lipolase®, Lipolase Ultra®, Lipoprime® and Lipex® from Novozymes. Also suitable for use herein are cutinases [EC 3.1.1.50]; esterases; carbohydrases such as mannanase (U.S. Pat. No. 6,060,299); pectate lyase (WO 99/27083) cyclomaltodextringlucanotransferase (WO 96/33267); and xyloglucanase (WO 99/02663). Additionally, nonlimiting examples of bleaching enzymes include peroxidases, accases, oxygenases, (e.g. catechol 1,2 dioxygenase, lipoxygenase (WO 95/26393), (non-heme) haloperoxidases.

(d) Perfume and Perfume Delivery System

As used herein the term "perfume" is used to indicate any odoriferous material. Suitable perfumes include but are not limited to one or more aromatic chemicals, naturally derived oils and mixtures thereof. Chemical classes for such aromatic chemicals and essential oils include but are not limited to alcohols, aldehydes, esters, ketones. Perfume is commonly provided with a perfume delivery system.

Suitable perfume delivery systems include but are not limited to perfume loaded cyclodextrins, amine assisted delivery systems, polymer-assisted perfume systems, reactive/pro-perfume systems and inorganic carrier systems. Perfume loaded cyclodextrin delivery systems comprise perfume materials or blends complexed with cyclodextrin type materials—a majority of the cyclodextrin may be alpha-, beta-, and/or gamma-cyclodextrin, or simply beta-cyclodextrin. Processes for producing cyclodextrins and cyclodextrin delivery systems are further described in U.S. Pat. Nos. 3,812,011, 4,317,881, 4,418,144 and 5,552,378.

Amine assisted delivery systems comprise one or more perfumes and a polymeric and/or non-polymeric amine material that is added separately from the perfume to the finished products. Such systems are described in WO 03/33635 and WO 03/33636.

Polymer-assisted delivery systems use physical bonding of polymeric materials and perfumes to deliver perfume materials. Suitable polymer assisted systems, include but not limited to, reservoir systems (coacervates, microcapsules, starch encapsulates), and matrix systems (polymer emulsions, latexes). Such systems are further described in WO 01/79303, WO 00/68352, WO 98/28339, and U.S. Pat. Nos. 5,188,753 and 4,746,455.

Reactive/pro perfumes systems include, but are not limited to, polymeric pro-perfumes that comprise perfume materials, typically aldehyde or ketone perfumes, reacted with polymeric carriers, typically nitrogen based carriers, prior to addition to a product; non-polymeric pro-perfume systems that comprise perfume materials reacted with non-polymeric materials for example, Michael adducts (β-amino ketones), Schiff bases (imines), oxazolidines, β-Keto Esters, orthoesters and photo pro-perfumes. Such systems are further described in WO 00/24721, WO 02/83620 and U.S. Pat. Nos. 6,013,618 and 6,451,751.

Inorganic carrier systems that comprise inorganic materials (porous zeolites, silicas, etc.) that are loaded with one or more perfume materials. Such systems are further described in U.S. Pat. Nos.: 5,955,419, 6,048,830 and 6,245,732.

(e) Softening Agents

Suitable fabric softening agents or actives include, but are not limited to, diester quaternary ammonium compounds (DEQA); polyquaternary ammonium compounds; triethanolamine esterified with carboxylic acid and quaternized (so called "esterquat"); amino esterquats; cationic diesters; betaine esters; cationic polymers of cyclic polyols and/or reduced saccharides (so called "polyol polyesters" or "Sefose"); silicone or silicone emulsions comprising aminosilicones, cationic silicones, quat/silicone mixtures; functionalized PDMS; and mixtures thereof.

Deposition aids, typically comprise a cationic moiety, can also be used in combination with softening agents.

Nonlimiting examples of quaternaty ammonium type softeners may be selected from the group consisting of: N,N-dimethyl-N,N-di(tallowyloxyethyl) ammonium methylsulfate, N-methyl-N-hydroxyethyl-N,N-di(canoyloxyethyl) ammonium methylsulfate and mixtures thereof.

Additional examples of non-silicone fabric softening agents and deposition aids are described in EP 902 009; WO 99/58492; U.S. Pat. No. 4,137,180; WO 97/08284; WO 00/70004; WO 00/70005; WO 01/46361; WO 01/46363; WO 99/64661; WO 99/64660; JP 11-350349; JP11-081134; and JP 11-043863. Additional examples of silicone fabric softening agents and deposition aids are described in U.S. Pat. No. 4,448,810; U.S. Pat. No. 4,800,026; U.S. Pat. No. 4,891,166; U.S. Pat. No. 5,593,611; EP 459 821; EP 530 974; WO 92/01773; WO 97/32917; WO 00/71806; WO 00/71807; WO 01/07546; WO 01/23394; JP 2000-64180; JP 2000-144199; JP 2000-178583; and JP 2000-192075.

(f) Finishing Polymers

The finishing polymers can be natural, or synthetic, and can act by forming a film, and/or by providing adhesive properties. For example, the present invention can optionally use film-forming and/or adhesive polymer to impart shape retention to fabric, particularly clothing: By "adhesive" it is meant that when applied as a solution or a dispersion to a fiber surface and dried, the polymer can attach to the surface. The polymer can form a film on the surface, or when residing between two fibers and in contact with the two fibers, it can bond the two fibers together.

Nonlimiting examples of the finishing polymer that are commercially available are: polyvinylpyrrolidone/dimethylaminoethyl methacrylate copolymer, such as Copolymer 958®, molecular weight of about 100,000 and Copolymer 937, molecular weight of about 1,000,000, available from GAF Chemicals Corporation; adipic acid/dimethylaminohydroxypropyl diethylenetriamine copolymer, such as Cartaretin F-4® and F-23, available from Sandoz Chemicals Corporation; methacryloyl ethyl betaine/methacrylates copolymer, such as Diaformer Z-SM®, available from Mitsubishi Chemicals Corporation; polyvinyl alcohol copolymer resin, such as Vinex 2019®, available from Air Products and Chemicals or Moweol®, available from Clariant; adipic acid/epoxypropyl diethylenetriamine copolymer, such as Delsette 101®, available from Hercules Incorporated; polyamine resins, such as Cypro 515®, available from Cytec Industries; polyquaternary amine resins, such as Kymene 557H®, available from Hercules Incorporated; and polyvinylpyrrolidone/acrylic acid, such as Sokalan EG 310®, available from BASF.

Additional examples of suitable finishing polymers include but are not limited to starch carboxymethyl cellulose, hydroxypropyl methyl cellulose, and mixtures thereof.

(g) Other Fabric Care Actives

Nonlimiting examples of suitable UV protection agents include benzopyrrolidone derivatives (WO 00/65142); sacrificial photofading prevention to retard color fading and/or cinnamate derivatives such as levafix in combination with di-long chain quats (WO 00/00577); aminonapthalene derivatives: fabric substantive sunscreens (WO 99/50379); deposition of UV absorbers via cellulose monoacetate; methoxy cinnamate derivatives (WO 00/18861 and WO 00/18862); esters of PVA and/or SCMC with UV absorbers to enhance active deposition (WO 00/18863); deposition of 2 ethylhexyl 4 methoxy cinnamate in non-ionic/cationic product (WO 97/44422); deposition of UV absorbers of ClogP>4 from rinse products (WO 97/44424); cationic UV absorbers (WO 98/30663); use of hindered amines to retard UV fading of dyed fabrics (WO 01/38470 and WO 01/07550); cationic singlet oxygen quenchers to retard photofading (EP 832 967); NCO containing polymers in combination with water soluble sunscreens (WO 98/49259); antioxidant+tinuvin in rinse conditioner (U.S. Pat. No. 5,962,402); benzotriazole UV absorbers (U.S. Pat. No. 5,733,855).

Nonlimiting examples of suitable dye transfer inhibiting (DTI) agents and/or dye fixing agents include black dye to restore fabric color (WO 99/66019); vinyl-imidazole-acrylic acid copolymers as DTI agents (WO 00/17296); llama UHH antibodies to prevent Red 6 dye transfer (WO 99/46300); acrylic/vinylimidazole copolymers as DTI agents (WO 98/30664); compositions containing selected DTI agents and silica or zeolite as a carrier material; Chromabond+Gasil silica or zeolite; Tinofix; Burcofix; PVP (N-polyvinylpyrrolidone); photoinitiators; hydroxyacetophenone; phosphine oxide derivatives; compositions with reactive polymer (eg amide/epichlorhydrin resin) and reactive anionic polymer and carrier for improved dye fix. (WO 01/25386); PVP/PVI (N-vinylpyrrolidone/N-vinylimidazole copolymer) compositions (U.S. Pat. No. 5,977,046 and WO 97/23591); hyperbranched polymer/dendrimer (EP 875 521); dendritic macromolecule, amine containing (U.S. Pat. No. 5,872,093 and EP 779 358); propylenediamine and piperazine (WO 00/15745) for dye fixing benefits; CMC combinations to reduce fiber mechanical damage and dye loss (WO 00/22079, WO 00/22078, WO 00/22077 and WO 00/22075); dimethyl diallyl based polymers as dye fixing agents (WO 00/56849); polymeric cyclic amines (WO 99/14299); copolymers of epichlorhydrin and cyclic amines together with semi polar nonionics (WO 01/32815 and WO 01/32816); high molecular weight polymers of N-vinylimidazole/N-vinylpyrrolidone as DTI agent (DE 19 621 509); polycationics as dye fixatives (DE 19 643 281); aminosilicones as dye removal protectors and prolonged perfume release (WO 98/39401) and mixtures thereof.

Nonlimiting examples of suitable wrinkle reducing and/or removing agents include use of oxidised polyethylene (DE19 926 863); sulfated castor oil and/or ethoxylated silicones and/or amino PDMS and/or polyacrylamides; Magnasoft® SRS, Silwet® L-7622 (WO 00/24853 and WO 00/24857); ethoxylated PDMS and acrylic polymers (WO 00/27991); emulsion of high viscosity silicone oil and esterquat (WO 00/71806); aliphatic unsaturated hydrocarbons; squalene; paraffin (WO 01/34896); styrene-isoprene or styrene butadiene polymers (WO 01/38627); incorporation of silicone polymers into crosslinked cellulose; silicone carboxylates or silanol containing reacted with acid treated cellulose (WO 01/44426); acrylics with PDMS; arabinogalactans; silicone emulsions; isomaltosuccinamides (WO 00/24851 and WO 00/24856 and WO 00/24858); natural cotyledon extract (WO 01/07554); cellulosic based anti-wrinkle technology containing triazine or pyrimidine units and a cross linking agent (WO 01/23660); cationic polyamide/epichlorhydrin resin and silicone lubricant compositions (EP 1 096 056); wrinkle reducing compositions containing silicone and film forming polymer (WO 96/15309); wrinkle reducing compositions containing non-ionic polyhydric alcohol (WO 99/55948 and WO 99/55949); curable aminofunctionalized silicone/fabric softening compositions (U.S. Pat. No. 5,174,912); polyacrylate/dihydroxyethylurea (WO 01/16262) and mixtures thereof. It is understood that some of these wrinkle reducing agents also provide fabric softening benefits.

Nonlimiting examples of fabric rebuild agents and/or fiber repair agents include production of N-alkoxylated chitin/chitosan as reviving agent (DE 10 019 140); cellulose monoacetate as fabric rebuild agent, such as the use of cellulosic polymers as deposition aids for various benefit agents (WO 00/18860, WO 00/18861 and WO 00/18862); cationic polyamine/epichlorhydrin resin crosslinked as fabric rebuild agent; Apomul SAK® (WO 01/25386); polymeric materials capable of self crosslinking or reacting with cellulose; includes reactive polyurethanes (WO 01/27232); compositions containing polyssacharide gum of low molecular weight such as locust bean gum, such gums can be produced in situ via enzyme cleavage, such as Xyloglucans (WO 00/40684 and WO 00/40685); polysaccharide/cellulose ester (acetate); specific substituted rebuild polymers (WO 01/72936 and WO 01/72940 to WO 01/72944); hydrophobized CMC to prevent fibre entanglement (WO 00/42144 and WO 00/47705); high molecular weight PEIs crosslinked with dibasic acids or epichlorhydrin for abrasion resistance (WO 00/49122); propylene diamine polymer derivatives for abrasion resistance (WO 00/49123); lysine caprolactam polymers for abrasion resistance (WO 00/49125); film forming cellulose ethers applied from rinse conditioner (WO 00/65015); lysine/amine or adipic acid copolymers for fiber appearance (WO 99/07813 and WO 99/07814) and mixtures thereof.

Nonlimiting examples of suitable shape retention agents include compositions containing PAE resin (e.g., Apomul SAK) and silicone to provide dimensional stability (WO 00/15747 and WO 00/15748); cationic amine/epichlorhydrin resin (PAE resin) as fabric shape retention agents for dryer applications (WO 00/15755); anionic polymer capable of self cross linking and reacting with cellulose, eg carbamoyl sulfonate terminated blocked isocyanates; provide dimensional stability (WO 01/25387) and mixtures thereof.

Nonlimiting examples of suitable targeting agents are developed in technologies such as attachment of large molecules to cellulose binding polysaccharides (WO 99/36469); attachment of antibodies to functional material and adsorption onto fabric surface (WO 01/46364 and WO 01/48135); proteins having a cellulosic binding domain (CBD) attached to particles via antibody link, enhancement of perfume containing coacervates onto cotton (WO 01/46357); delivery of benefit agent to fabric via peptide or protein deposition aid (WO 98/00500); benefit agent attached to mimic cellulose binding domain (WO 01/34743 and WO 01/32848) and mixtures thereof.

Nonlimiting examples of suitable irritant reducing agents include reduced irritancy of as laundered fabrics via treatment with Lever quaternary ammonium materials (WO 00/17297).

Nonlimiting examples of suitable anti-discoloring agents include phosphonated terminated polyacrylate to provide lower yellowing potential during fabric bleaching (DE 19 904 230).

Nonlimiting examples of suitable hydrophobic finishing agents include polylysine as hydrophobic finishing agent (DE 19 902 506).

Nonlimiting examples of suitable antibacterial agents include combination of amber and musk materials to mask malodor (WO 98/56337); antibacteriocidal compositions containing 5-chlorosalicylanilide (WO 01/60157); antimicrobial compositions containing aminoalkyl silicone, improved surface residuality (WO 96/19194); antimicrobial polypeptides (WO 96/28468); antimicrobial compositions containing aromatic alcohols and phenols (WO 98/01524); antimicrobial activity of alcohols (WO 97/21795); betaine compositions with good antimicrobial activity (WO 97/43368 and WO 97/43369); high pH non-ionic solutions as antimicrobial agents (WO 01/44430); capsule for controlled release of textile treatment agents (DE 19 931 399); composition containing benzylakylammonium, zinc PTO, climbazole (WO 98/01527); alkyldimethylammonium and alcohol ehtoxylates as effective antibacterial compositions (GB 2 322 552); cyclohexyl esters for odor neutralization (WO 01/43784); alkoxy disulphide antimicrobial agents (EP 1 008 296); bromofuranones as antibacterial agents (WO 01/43739) and mixtures thereof.

Brighteners can be organic compounds that absorb the invisible ultraviolet (LV) radiation energy and converts this energy into the longer wavelength radiation energy. The terms "brightener", "optical brightener" and "whitener" are used interchangeably. Nonlimiting examples of brighteners include derivatives of stilbene, pyrazoline, coumarin, carboxylic acid methinecyannines, dibenzothiophene-5,5-dioxide, azoles, 5- and 6-membered ring heterocycles, and the like. Examples of brighteners are disclosed in "The Production and Application of Fluorescent Brightening Agents", M. Zahradnik, published by John Wiley & Sons, New York (1982).

(4) Carrier Phase Surfactant

Surfactants may be included in the carrier for dispersing the fabric care actives in the carrier phase. Thus, the carrier phase (i.e., the second phase) itself may comprise an emulsion, wherein the fabric care active is the dispersed phase and the carrier is the continuous phase. Such an emulsion within an emulsion system is exemplified in an O/W/O emulsion, wherein an oily or water insoluble substance (e.g., fabric care actives) is suspended in water, which forms droplets dispersed in the continuous lipophilic matrix. In one embodiment of the present invention, the O/W/O emulsion is formed when the fabric care active is a water insoluble perfume oil. In another embodiment, the multi-phasic emulsion is formed when the fabric care active is a F-SRP or a Si-SRP.

The amount of carrier phase surfactants ranges from about 0.0005% about 3%, or from about 0.001% to about 2%, or from about 0.002% to about 1%, by weight of the delivery system.

Nonlimiting examples of suitable surfactants for suspending fabric care active within the carrier droplets include siloxane-based surfactants; anionic surfactants; nonionic surfactants; cationic surfactants; zwitterionic surfactants; ampholytic surfactants; semi-polar nonionic surfactants; gemini surfactants; amine surfactants; alkanolamine surfactants; phosphate-containing surfactants; and fluorosurfactants.

Silicone-Based Surfactants

Another class of emulsifiers suitable for use herein are siloxane-based surfactants having the formula (III): $M_aD_bD'_cD''_d$ as described above. In order to function as a surfactant in the carrier phase, these silicon based surfactants are more hydrophilic than the SRPs. For example, silicone bases surfactants can be derived from poly(alkylsiloxane) by ethoxylation and/or propoxylation to impart hydrophilicity to the siloxanes. The siloxane-based surfactants typically have a weight average molecular weight from 500 to 20,000 daltons. Examples of the types of siloxane-based surfactants described herein above may be found in EP 1,043,443A1, EP 1,041,189 and WO01/34,706 (all assigned to GE Silicones) and U.S. Pat. No. 5,676,705, U.S. Pat. No. 5,683,977, U.S. Pat. No. 5,683,473, and EP 1,092,803A1 (all assigned to Lever Brothers). Nonlimiting commercially available examples of suitable siloxane-based surfactants are TSF 4446 (from General Electric Silicones), XS69-B5476 (from General Electric Silicones); Jenamine® HSX (from DelCon) and Y12147 (from OSi Specialties).

Hydrophilic aminosilicones, such as XS69-B5476 (from General Electric) with alkoxyl groups, are also suitable for use in the present invention.

Nonionic Surfactants

Non-limiting examples of nonionic surfactants include:

a) $C_9$-$C_{18}$ alkyl ethoxylates, such as, NEODOL® nonionic surfactants from Shell;
b) $C_6$-$C_{12}$ alkyl phenol alkoxylates wherein the alkoxylate units are a mixture of ethyleneoxy and propyleneoxy units;
c) $C_{12}$-$C_8$ alcohol and $C_6$-$C_{12}$ alkyl phenol condensates with ethylene oxide/propylene oxide block polymers such as Pluronic® from BASF;
d) $C_{14}$-$C_{22}$ mid-chain branched alcohols, BA, as discussed in U.S. Pat. No. 6,150,322;
e) $C_{14}$-$C_{22}$ mid-chain branched alkyl alkoxylates, $BAE_x$, wherein x 1-30, as discussed in U.S. Pat. No. 6,153,577, U.S. Pat. No. 6,020,303 and U.S. Pat. No. 6,093,856;
f) Alkylpolysaccharides as discussed in U.S. Pat. No. 4,565,647 Llenado, issued Jan. 26, 1986; specifically alkylpolyglycosides as discussed in U.S. Pat. No. 4,483,780 and U.S. Pat. No. 4,483,779;
g) Polyhydroxy fatty acid amides as discussed in U.S. Pat. No. 5,332,528, WO 92/06162, WO 93/19146, WO 93/19038, and WO 94/09099;
h) ether capped poly(oxyalkylated) alcohol surfactants as discussed in U.S. Pat. No. 6,482,994, WO 01/42408, and WO 01/42408; and
i) fatty acid ($C_{12}$-$_{18}$) sorbitan esters, Span®, and their ethoxylated ($EO_{5-100}$) derivatives, polysorbates; such as Span® 20, Tween® 20, Tween® 60, Tween® 80 (commercially available from Uniqema).

Other examples of ethoxylated surfactant include carboxylated alcohol ethoxylates; ethoxylated quaternary ammonium surfactants; and ethoxylated alkyl amines.

Semi-Polar Nonionic Surfactants

Non-limiting examples of semi-polar nonionic surfactants include: water-soluble amine oxides containing alkyl and hydroxyalkyl moieties; water-soluble phosphine oxides containing alkyl and hydroxyalkyl moieties; and water-soluble sulfoxides containing alkyl and hydroxyalkyl moieties; as discussed in WO 01/32816, U.S. Pat. No. 4,681,704, and U.S. Pat. No. 4,133,779.

Cationic Surfactants

Non-limiting examples of cationic surfactants include: the quaternary ammonium surfactants, which can have up to 26 carbon atoms.

a) alkoxylate quaternary ammonium (AQA) surfactants as discussed in U.S. Pat. No. 6,136,769;
b) dimethyl hydroxyethyl quaternary ammonium as discussed in U.S. Pat. No. 6,004,922;
c) polyamine cationic surfactants as discussed in WO 98/35002, WO 98/35003, WO 98/35004, WO 98/35005, and WO 98/35006;
d) cationic ester surfactants as discussed in U.S. Pat. Nos. 4,228,042, 4,239,660 4,260,529 and 6,022,844; and
e) amino surfactants as discussed in U.S. Pat. No. 6,221,825 and WO 00/47708, specifically amido propyldimethyl amine.

Anionic Surfactants

Nonlimiting examples of anionic surfactants useful herein include: alkyl sulfonates, such as $C_{11}$-$C_{18}$ alkyl benzene sulfonates (LAS) or $C_{10}$-$C_{20}$ branched-chain and random alkyl sulfates (AS); $C_{10}$-$C_{18}$ alkyl alkoxy sulfates ($AE_xS$) wherein x is from 1-30; mid-chain branched alkyl sulfates (U.S. Pat. No. 6,020,303 and U.S. Pat. No. 6,060,443) or mid-chain branched alkyl alkoxy sulfates (U.S. Pat. No. 6,008,181 and U.S. Pat. No. 6,020,303); $C_{10}$-$C_{18}$ alkyl alkoxy carboxylates comprising 1-5 ethoxy units; modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; $C_{12}$-$C_{20}$ methyl ester sulfonate (MES); $C_{10}$-$C_{18}$ alpha-olefin sulfonate (AOS); and $C_6$-$C_{20}$ sulfosuccinates.

Other Surfactants

Nonlimiting examples of other suitable carrier phase surfactants include:

a) alkanolamines and derivatives thereof;
b) phosphate/phosphonate ethers;
c) zwitterionic surfactants (U.S. Pat. No. 3,929,678) such as derivatives of secondary and tertiary amines, derivatives of heterocyclic secondary and tertiary amines, or derivatives of quaternary ammonium, quaternary phosphonium or tertiary sulfonium compounds; and $C_8$ to $C_{18}$ (or $C_{12}$ to $C_{18}$) amine oxides;
d) ampholytic surfactants (U.S. Pat. No. 3,929,678) such as aliphatic derivatives of secondary or tertiary amines, or aliphatic derivatives of heterocyclic secondary and tertiary amines in which the aliphatic radical can be straight- or branched-chain sulfate;
e) gemini surfactants are compounds having at least two hydrophobic groups and at least two hydrophilic groups per molecule have been introduced, nonlimiting examples are disclosed in U.S. Pat. No. 5,160,450, U.S. Pat. No. 3,244,724, U.S. Pat. Nos. 2,524,218, 2,530,147, 2,374,354, and U.S. Pat. No. 6,358,914;
f) amine surfactants include primary alkylamines comprising from about 6 to about 22 carbon atoms, nonlimiting examples are oleylamine (commercially available from Akzo under the trade name ARMEEN OLD®), dodecylamine (commercially available from Akzo under the trade name ARMEEN 12D®), branched $C_{16}$-$C_{22}$ alkylamine (commercially available from Rohm & Haas under the trade name PRIMENE JM-T®; and
g) fluorosurfactants include fluoroalkyl carboxylates, fluoroalkyl phosphates, fluoroalkyl sulfates, fluoroalkyl ethoxylates, quaternary ammonium salts of fluorosurfactants; and betaines, including alkyl betaines, sulfo betaines and hydroxy betaines; some exemplary fluorosurfactants are available from 3M under the tradename FLUORAD®, and from Clariant under the tradename FLUOWET®.

(5) Adjunct Ingredients

The present invention may further include adjunct ingredients useful in the non-aqueous solvent based washing system. Although solubility in water or lipophilic fluid is not required, suitable adjunct ingredients are materials soluble in water, in lipophilic fluid, or in both. These adjunct ingredients can be selected from those materials that can be safely disposed down the drain, as is or after additional treatment, within all constraints on environmental fate and toxicity (e.g. biodegradability, aquatic toxicity, pH, etc.). However, disposability down the drain is not required for the adjunct ingredients in the present invention. "Down the drain", as used herein, means both the conventional in-home disposal of materials into the municipal water waste removal systems such as by sewer systems or via site specific systems such as septic systems, as well as for conmmercial applications the removal to on-site water treatment systems or some other centralized containment means for collecting contaminated water from the facility. The adjunct ingredients can vary widely and can be used at widely ranging levels.

Some suitable adjunct ingredients include, but are not limited to, builders, alkalinity sources, colorants, lime soap dispersants, odor control agents, odor neutralizers, crystal growth inhibitors, heavy metal ion sequestrants, anti-tarnishing agents, anti-microbial agents, anti-oxidants, anti-redeposition agents, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, hydrotropes, suds or foam suppressors, suds or foam boosters and mixtures thereof.

Preparation of the Delivery System

In one embodiment, water, one or more fabric care actives, and optionally a carrier phase surfactant are premixed. The premix is then dispersed in the lipophilic fluid to form the delivery system of the present invention. The emulsifier can be added in any step. In another embodiment, the carrier phase premix comprising water, fabric care actives and optionally a surfactant, and the lipophilic phase premix comprising the lipophilic fluid and the emulsifier, are mixed to for the two-phased delivery system. In yet another embodiment, water, lipophilic fluid, fabric care actives, the emulsifiers, and optionally the carrier phase surfactants, are mixed together, simultaneously or in any order, to form the two-phased delivery system. Input of mechanical energy (such as stirring, shaking or vortexing) may be used to help breaking up the water droplets to the desired size range and the partitioning of the actives between water and lipophilic fluid.

The delivery system can be prepared prior to being added to the treatment apparatus. Alternatively, one or more components of the delivery system can be added to separate holding tanks or containers within the treatment apparatus and mixed in the treatment apparatus to form the delivery system prior to being applied to the fabric article.

Method

The present invention also comprises a method of efficient and uniform deposition of a fabric care active onto a fabric article in a non-aqueous solvent based fabric treatment process. The method typically comprises the steps of: obtaining the two-phased delivery system comprising a lipophilic fluid phase, a carrier fluid phase, one or more fabric care actives and an emulsifying agent; applying the delivery system to a fabric article; and removing at least a portion of the lipophilic fluid from the delivery system. Optionally, lipophilic fluid and/or water in addition to the delivery system may be applied to the fabric article.

The two-phased delivery system can be applied to the fabric article by immersing, dipping, spraying, brushing on, rubbing on, and combinations thereof. The delivery system can be applied to a fabric article in a treatment apparatus during the washing cycle, the drying cycle or a fabric refreshing/treating cycle. The delivery system can also be applied to a fabric article outside of a treatment apparatus, for example, in a pre-or post-treating step.

The lipophilic fluid can be removed from the treated fabric article by heating, spinning, squeezing, wringing, or combinations thereof.

A desired amount of fabric care active may be deposited in one cycle or the same desired amount of fabric care active may be divided or separated into smaller amounts and the method completed more that one time resulting in the smaller amounts of fabric care active being deposited over a series of cycles to obtain the desired amount of fabric care active deposited on the fabric article.

In one embodiment, the fabric article is placed in the treatment apparatus, and the delivery system is applied such that it comes into contact with the fabric article inside the apparatus. Optionally, the delivery system and the fabric article are agitated together, or the fabric article is in motion so that the delivery system contacts the fabric article uniformly. An effective amount of the fabric care active is deposited onto the fabric article to achieve the desired fabric treating benefit. In a typical embodiment, the amount of fabric care active deposited onto the fabric article ranges from 0.001% to about 3%, or from about 0.01% to about 2%, or from about 0.1% to about 1% by the dry weight of the fabric article. In another embodiment, the amount of delivery system deposited onto the fabric article ranges from 0.01% to about 75%, or from about 0.1% to about 30%, or from about 1% to about 10% by the dry weight of the fabric article.

Next, the fabric article is heated from about 15° C. to about 200° C., or about 20° C. to about 160° C., or from about 30° C. to about 1 10° C., or from about 40° C. to about 90° C. Without being limited by theory, it is believed that curing, or heating the fabric care active to or above its melting temperature can be modified to match a consumer clothes dryer accomplish the heating or similar dryer that may be part of the non-aqueous solvent based wash system. See WO 01/94675.

An optional step of the method is the removal of the fabric article from the delivery system prior to heating of the fabric article.

Any suitable fabric article treating apparatus known to those of ordinary skill in the art can be used. The fabric article treating apparatus receives and retains a fabric article to be treated during the operation of the cleaning system. In other words, the fabric article treating apparatus retains the fabric article while the fabric article is being contacted by the dry cleaning solvent. Nonlimiting examples of suitable fabric article treating apparatuses include commercial cleaning machines, domestic, in-home, washing machines, and clothes drying machines. An exemplary treatment apparatus is described in U.S. application Ser. No. 09/849,893, filed May 4, 2001 (P&G Case 8119).

The methods and delivery systems of the present invention may be used in a service, such as a cleaning service, diaper service, uniform cleaning service, or commercial business, such as a Laundromat, dry cleaner, linen service which is part of a hotel, restaurant, convention center, airport, cruise ship, port facility, casino, or may be used in the home.

The methods of the present invention may be performed in an apparatus that is a modified existing apparatus and is retrofitted in such a manner as to conduct the method of the present invention in addition to related methods.

The methods of the present invention may also be performed in an apparatus that is specifically built for conducting the present invention and related methods.

Further, the methods of the present invention may be added to another apparatus as part of a dry cleaning solvent processing system. This would include all the associated plumbing, such as connection to a chemical and water supply, and sewerage for waste wash fluids.

EXAMPLES

A test method based on AATCC Test Method 118-1997 is used to show that the two-phased delivery system of the present invention is capable of delivering fabric care actives to a fabric to achieve satisfactory fabric care benefits and the benefit is uniform throughout the treated area. Moreover, this test method can also be used to screen emulsifiers. For example, to deliver a fluoro SRP to the fabric using the two-phased delivery system, an effective emulsifier would deliver (1) a satisfactory oil repellency/hydrophobicity from about 3 to about 8, or from about 4 to about 8, or from about 5 to about 8, as measured by the AATCC Test Method 118-1997; and (2) such oil repellency is consistently found throughout the treated area of the fabric.

The lipophilic fluid used in this test is decamethyl-cyclopentasiloxane (D5). Approximately 0.05% by weight of the lipophilic fluid of an emulsifying agent is added to a first and a second vial containing the lipophilic fluid. The samples blended by a vortex for approximately 30 seconds. In a third vial, a control sample containing only the lipophilic fluid is also prepared.

Approximately 0.001% by weight of the lipophilic fluid of FD&C Red #40 dye is added to the first vial and to the third vial containing the control sample. An aliquot of fluoro soil release polymer dispersed in water (as a 30 wt % solid content suspension is commercially available under the tradename Repearl® F-35 from Mitsubishi) is added to the second vial and the third vial containing the control sample. The resulting combination contains approximately 0.06% by weight of the lipophilic fluid of soil release polymer. The sample vials are shaken on a wrist shaker at approximately 950 rpm for 30 seconds. It has been found that the dye and the fluoro SRP in the control sample do not interfere with the test results. However, this test can optionally be done with separate control samples containing the dye or the fluoro SRP, respectively.

A 3.8 cm by 3.8 cm (1.5 inch by 1.5 inch) cotton swatch is added to each of the above vials. The resulting combination in the vials contain about 5.5 wt % cotton swatch, by weight of the lipophilic fluid. Shake the sample vials containing the cotton swatch(es) on a wrist shaker at approximately 950 rpm for 10 minutes.

Remove the cotton swatch(es) from the sample vials and place in a mesh bag and dry the cotton swatches in a conventional consumer hot air laundry dryer on the highest heat setting until completely dry. The cotton swatches are then annealed in an oven at 170° C. for 5 minutes. Perform the oil repellency test using mineral oil droplets according to AATCC Test Method 118-1997.

The cotton swatch from the first vial shows uniform deposition of the red dye, by visual observation. The cotton swatch from the second vial shows an oil repellency/hydrophobicity of about 5 and is substantially throughout the cotton swatch. In contrast, the control sample that does not contain the delivery system shows inhomogeneous deposition of the red dye as well as lower and inhomogeneous oil repellency. Similarly, when the test is repeated with a silicone soil release polymer in an aqueous suspension with 35 wt % solid content (commercially available under the tradename SM 2125® from GE Silicones) in the sample vial, and water droplets are used to test the treated cotton swatch, the two-phased delivery system of the present invention delivers substantially uniform and satisfactory water repellency to the cotton swatch treated in that vial.

Additionally, the test may include an additional step of quantifying the residual actives in the lipophilic fluid that are not deposited onto the cotton swatch. Generally known quantification methods can be used here, such as gravimetric method, titration, etc. For examples, a gravimetric method can be used if the active is a solid at room temperature. After the cotton swatch is removed from the vial, the content can be poured into a pre-weighed aluminum pan and evaporated. The final weight of the pan, minus the pre-weight of the pan is the amount of residual actives not deposited onto the cotton swatch.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

All percentages stated herein are by weight unless otherwise specified. It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All documents cited are, in relevant part, incorporated herein by reference; the citation of any document is not to be construed as an admission that it is prior art with respect to the present invention.

What is claimed is:

1. A delivery system for uniform and efficient deposition of fabric care active onto a fabric article in a non-aqueous fabric treatment process, the delivery system comprising:

i.) a first phase comprising a cyclic siloxane solvent lipophilic fluid;

ii.) a second phase comprising a water carrier and a fabric care active which is a curable amino silicone soil release polymer having a weight average molecular weight from about 1,000 to about 100,000;

and, optionally, a member selected from the group consisting of enzymes, perfumes, softening agents, finishing polymers, dye transfer inhibiting agents, dye fixatives, UV protection agents, wrinkle reducing/removing agents, fabric rebuild agents, fiber repair agents, perfume release and/or delivery agents, shape retention agents, fabric and/or soil targeting agents, antibacterial agents, anti-discoloring agents, hydrophobic finishing agents UV blockers, brighteners, pigments, pill prevention agents, temperature control technology, skin care lotions, fire retardants, and mixtures thereof, the carrier being substantially insoluble in the lipophilic fluid, said water carrier comprising from about 0.01% to about 5% at weight of the composition; and iii.) an effective amount of an emulsifying agent sufficient to emulsify the composition such that the second phase forms discrete particles; and iv.) perfume-loaded cyclodextrin;

and wherein the second phase is in the form of droplets having a median particle diameter ($\chi_{50}$) of less than about 1000 microns; or wherein in a 1 mL sample of the delivery system, greater than about 0.95 weight fraction of the second phase is in the form of droplets, each droplet having an individual weight of less than 1 wt %, of the total mass of the second phase in the 1 mL sample of the delivery system.

2. The delivery system of claim 1 wherein amount of fabric care active in the first phase versus the second phase ranges from about 1:2 to 1:1000.

3. The delivery system of claim 1 wherein a weight ratio of the carrier to the emulsifying agent ranges from about 10000:1 to about 1:1.

4. The delivery system of claim 1 wherein a weight ratio of the fabric care active to the carrier ranges about 1:1000 to about 3:1.

5. The delivery system of claim 1 wherein the lipophilic fluid is decamethylcyolopentasiloxane.

6. The delivery system of claim 1 wherein the water carrier optionally comprises linear or branched C1-C6 alcohols, C1-C4 glycols, or mixtures thereof.

7. The delivery system of claim 1 wherein the fabric care active has a logP value of greater than 0.

8. The delivery system of claim 1 wherein the fabric care active has a logP value of from about 1 to about −1.

9. The delivery system of claim 1 wherein greater than about 70 wt % of the fabric care actives is deposited onto the fabric article.

10. The delivery system of claim 1 wherein the emulsifying agent is a siloxane-based surfactant invention having the general formula:

$$Y_u\text{-}(L_t\text{-}X_v)_x\text{-}Y'_w \quad \text{(I)}$$

$$L_y\text{-}(X_v\text{-}Y_u)_x\text{-}L'_z \quad \text{(II)}$$

and mixtures thereof;

wherein L and L' are solvent compatibilizing (or lipophilic) moieties, which are independently selected from:

(a) C1-C22alkyl or C4-C12alkoxy, linear or branched, cyclic or acyclic, saturated or unsaturated, substituted or unsubstituted;

(b) siloxanes having the formula:

$$M_aD_bD'_cD''_d \quad \text{(III)}$$

wherein a is 0-2; b is 0-1000; c is 0-50; d is 0-50, provided that a+c+d is at least 1;

M of formula (III) is $R^1_{3-e}X_eSiO_{1/2}$ wherein $R^1$ of formula (III) is independently H, or an alkyl group, X of formula (III) is hydroxyl group, and e is 0 or 1;

D of formula (III) is $R^4_2SiO_{2/2}$ wherein $R^4$ of formula (III) is independently H or an alkyl group;

D' of formula (III) is $R^5_2SiO_{2/2}$ wherein $R^5$ of formula (III) is independently H, an alkyl group, or $(CH_2)_f(C_6Q_4)_gO—(C_2H_4O)_h—(C_3H_6O)_i(C_kH_{2k})_j—R^3$, provided that at least one $R^5$ of formula (III) is $(CH_2)_f(C_6Q_4)_gO—(C_2H_4O)_h—(C_3H_6O)_i(C_kH_{2k})_j—R^3$, (formula IIIb) wherein $R^3$ of formula (IIIb) is independently H, an alkyl group or an alkoxy group, f of formula (IIIb) is 1-10, g of formula (IIIb) is 0 or 1, h of formula (IIIb) is 1-50, i of formula (IIIb) is 0-50, j of formula (IIIb) is 0-50, k of formula (IIIb) is 4-8; $C_6Q_4$ of formula (IIIb) is unsubstituted or substituted with Q of formula (IIIb) is independently H, $C_{1-10}$ alkyl, $C_{1-10}$ alkenyl, and mixtures thereof, D" of formula (III) is $R^6_2SiO_{2/2}$ wherein $R^6$ of formula (III) is independently H, an alkyl group or $(CH_2)_l(C_6Q_4)_m(A)_n\text{-}[(T)_o\text{-}(A')_p\text{-}]_q\text{-}(T')_rZ(G)_s$ (formula IIIc), wherein l of formula (IIIc) is 1-10; m of formula (IIIc) is 0 or 1; n of formula (IIIc) is 0-5; o of formula (IIIc) is 0-3; p of formula (IIIc) is 0 or 1; q of formula (IIIc) is 0-10; r of formula (IIIc) is 0-3; s of formula (IIIc) is 0-3; $C_6Q_4$ of formula (IIIc) is unsubstituted or substituted with Q of formula (IIIc) is independently H, $C_{1-10}$ alkyl, $C_{1-10}$ alkenyl, and mixtures thereof; A and A' of formula (IIIc) are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; T and T' of formula (IIIc) are each independently a $C_{1-30}$ straight chained or branched alkyl or alkenyl or an aryl which is unsubstituted or substituted; Z of formula (IIIc) is a hydrogen, carboxylic acid, a hydroxy, a phosphato, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium; G of formula (IIIc) is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate;

Y and Y' are hydrophilic moieties, which are independently selected from hydroxy; polyhydroxy; C1-C3 alkoxy; mono- or di-alkanolamine; C1-C4 alkyl substituted alkanolamine; substituted heterocyclic containing O, S, N; sulfates; carboxylate; carbonate; and when Y and/or Y' is ethoxy (EO) or propoxy (PO), it must be capped with R, which is selected from the group consisting of:

(i) a 4 to 8 membered, substituted or unsubstituted, heterocyclic ring containing from 1 to 3 hetero atoms; and (ii) linear or branched, saturated or unsaturated, substituted or unsubstituted, cyclic or acyclic, aliphatic or aromatic hydrocarbon radicals having from about 1 to about 30 carbon atoms;

X is a bridging linkage selected from O; S; N; P; C1 to C22 alkyl, linear or branched, saturated or unsaturated, substituted or unsubstituted, cyclic or acyclic, aliphatic or aromatic, interrupted by O, S, N, P; glycidyl, ester, amido, amino, $PO_4^{2-}$, $HPO_4^-$, $PO_3^{2-}$, $HPO_3^-$, which are protonated or unprotonated;

u and w are integers independently selected from 0 to 20, provided that $u+w \geqq 1$;

t is an integer from 1 to 10;

v is an integer from 0 to 10;

x is an integer from 1 to 20; and y and z are integers independently selected from 1 to 10.

11. The delivery system of claim 1 wherein the second phase comprises a surfactant selected from the group consisting of siloxane-based surfactants; anionic surfactants; nonionic surfactants; cationic surfactants; zwitterionic surfactants; ampholytic surfactants; semi-polar nonionic surfactants; gemini surfactants; amine surfactants; alkanolamine surfactants; phosphate-containing surfactants; fluorosurfactants; and mixtures thereof.

* * * * *

UNITED STATES PATENT AND TRADEMARK OFFICE

CERTIFICATE OF CORRECTION

PATENT NO. : 7,462,589 B2
APPLICATION NO. : 10/876032
DATED : December 9, 2008
INVENTOR(S) : Keith Homer Baker et al.

It is certified that error appears in the above-identified patent and that said Letters Patent is hereby corrected as shown below:

Column 10
Line 40, delete "R'" and insert -- R" --.

Column 17
Line 16, delete "(LV)" and insert -- (UV) --.

Column 18
Line 17, delete "$C_{12}$-$C_8$" and insert -- $C_{12}$-$C_{18}$ --.

Column 20
Line 3, delete "conmmercial" and insert -- commercial --.

Column 21
Line 24, delete "1 10°" and insert -- 110° --.

Claim 5
Line 2, delete "decamethylcyolopentasiloxane" and insert
-- decamethylcyclopentasiloxane --.

Claim 10
Line 2, delete "invention".

Signed and Sealed this

Tenth Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,462,589 B2
APPLICATION NO. : 10/876032
DATED : December 9, 2008
INVENTOR(S) : Keith Homer Baker et al.

It is certified that error appears in the above-identified patent and that said Letters Patent is hereby corrected as shown below:

Column 10
Line 40, delete "R'" and insert -- R" --.

Column 17
Line 16, delete "(LV)" and insert -- (UV) --.

Column 18
Line 17, delete "$C_{12}$-$C_8$" and insert -- $C_{12}$-$C_{18}$ --.

Column 20
Line 3, delete "conmmercial" and insert -- commercial --.

Column 21
Line 24, delete "1 10°" and insert -- 110° --.

Column 24, Claim 5
Line 8, delete "decamethylcyolopentasiloxane" and insert
-- decamethylcyclopentasiloxane --.

Column 24, Claim 10
Line 20, delete "invention".

This certificate supersedes the Certificate of Correction issued November 10, 2009.

Signed and Sealed this

First Day of December, 2009

David J. Kappos

David J. Kappos
*Director of the United States Patent and Trademark Office*